United States Patent [19]

Kelman

[11] Patent Number: 4,571,900

[45] Date of Patent: Feb. 25, 1986

[54] SURGICAL OPERATING ROOM STRUCTURE

[76] Inventor: Charles D. Kelman, North Shore Towers, 269 Grand Central Pkwy., Bldg 3, Floral Park, N.Y. 11005

[21] Appl. No.: 535,608

[22] Filed: Sep. 26, 1983

[51] Int. Cl.[4] ..... E04B 1/346

[52] U.S. Cl. ..... 52/65; 52/7; 128/1 R

[58] Field of Search ..... 52/7, 29, 63, 64, 65, 52/236.1, 31, 36; 312/209, 242, 249, 252, 266; 128/1 R, 906

[56] References Cited

U.S. PATENT DOCUMENTS

| | | | |
|---|---|---|---|
| 1,880,147 | 9/1932 | Mulling | 52/31 |
| 3,395,500 | 8/1968 | Smith | 52/65 |
| 3,623,283 | 11/1971 | Abromavage | 52/29 |
| 3,696,805 | 10/1972 | Sweeten et al. | 52/65 |
| 4,095,379 | 6/1978 | Weintraub | 52/29 |

FOREIGN PATENT DOCUMENTS

| | | | |
|---|---|---|---|
| 1167603 | 10/1969 | United Kingdom | 128/1 R |

*Primary Examiner*—John E. Murtagh
*Assistant Examiner*—Andrew Joseph Rudy
*Attorney, Agent, or Firm*—Henry Sternberg; Bert J. Lewen

[57] ABSTRACT

A surgical operating room structure having prep room, operating room and post-operative room around a central core and separated by flexible curtains. The core comprises independently movable sections each having an arm supporting an operating table which is rotatable about the core from one room to the next adjacent room through the curtains.

13 Claims, 3 Drawing Figures

SURGICAL OPERATING ROOM STRUCTURE

This invention relates to a surgical operating room structure and, more particularly, to such a structure comprising an operating room, a prep room for preparing a patient for an operation, and a post-operative room for servicing the patient just subsequent to an operation.

Previous surgical rooms have required that the patient be wheeled on a table on wheels from one room to the next, requiring hospital personnel for the transfer and possibly involving delay.

It is an object of the present invention, therefore, to provide a new and improved surgical operating room structure which avoids one or more of the above-mentioned disadvantages and limitations of prior such structures.

It is another object of the invention to provide a new and improved surgical operating room structure in which a patient is transferred automatically from one room to the next.

In accordance with the invention, a surgical operating room structure comprises a central core and a housing surrounding the core and forming a work space as its interior. The structure also includes a plurality of generally outwardly extending curtain means within the housing for dividing the work space into a plurality of compartments. A plurality of arms are supported by and extend generally radially outwardly from the core and are movable in circumferential direction thereabout. Each of the arms extends into the housing and is adapted to support an operating table. The curtain means each comprise a movable portion adapted to be opened to permit movement of an arm therethrough from one compartment into the next adjacent compartment and adapted to be closed again subsequent to each such movement, whereby a patient already on an operating table may enter the structure in a first compartment where the operating table is supported by the arm in that compartment and the arm supporting the operating table and patient is then rotated through the curtain means separating the aforesaid first compartment from the next adjacent compartment, into the next adjacent compartment.

For a better understanding of the present invention, together with other and further objects thereof, reference is made to the following description, taken in connection with the accompanying drawings, and its scope will be pointed out in the appended claims.

Referring now to the drawings.

Figure 1:
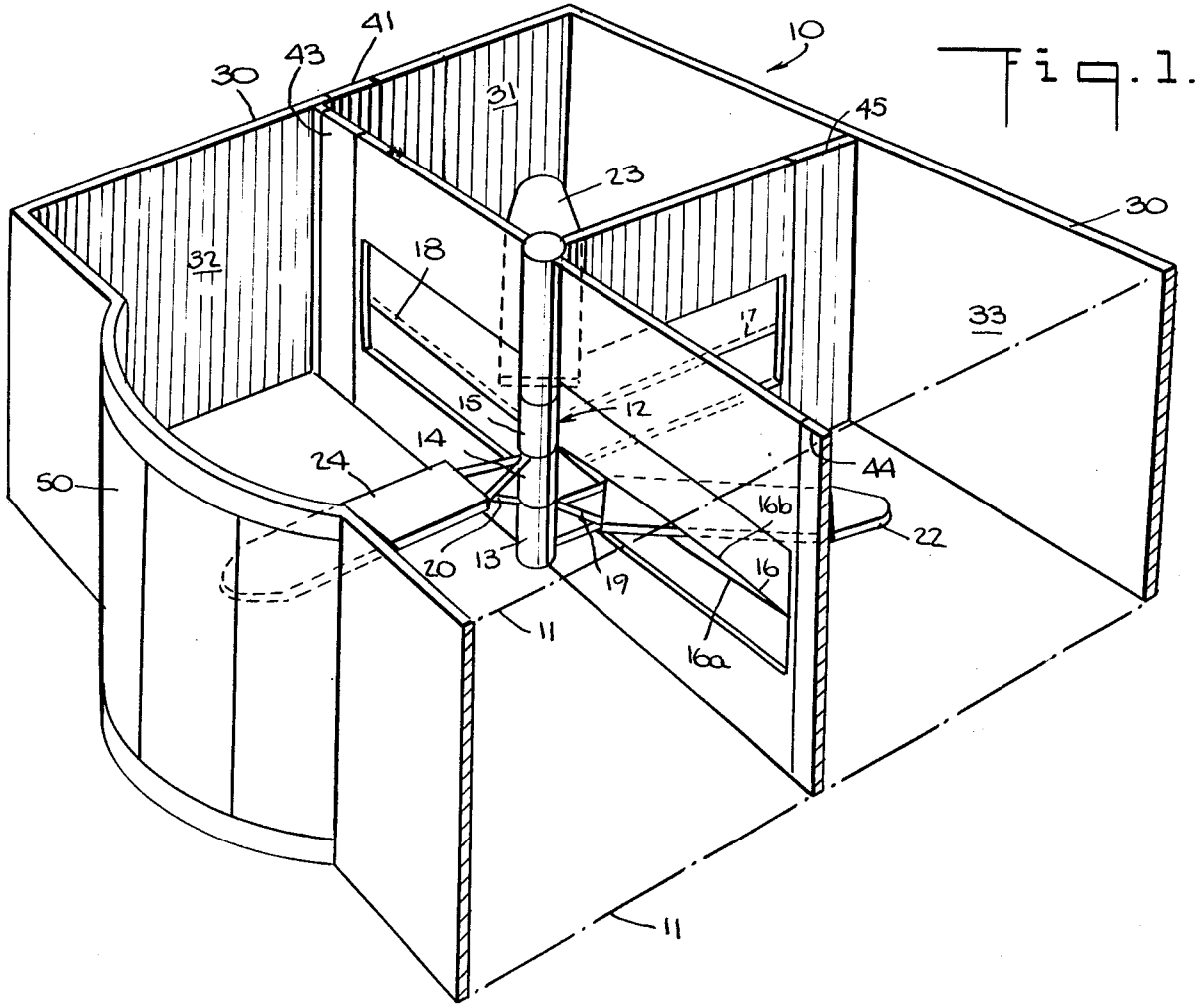
FIG. 1 is a fragmentary perspective view of a surgical operating room structure constructed in accordance with the invention.
Figure 2:
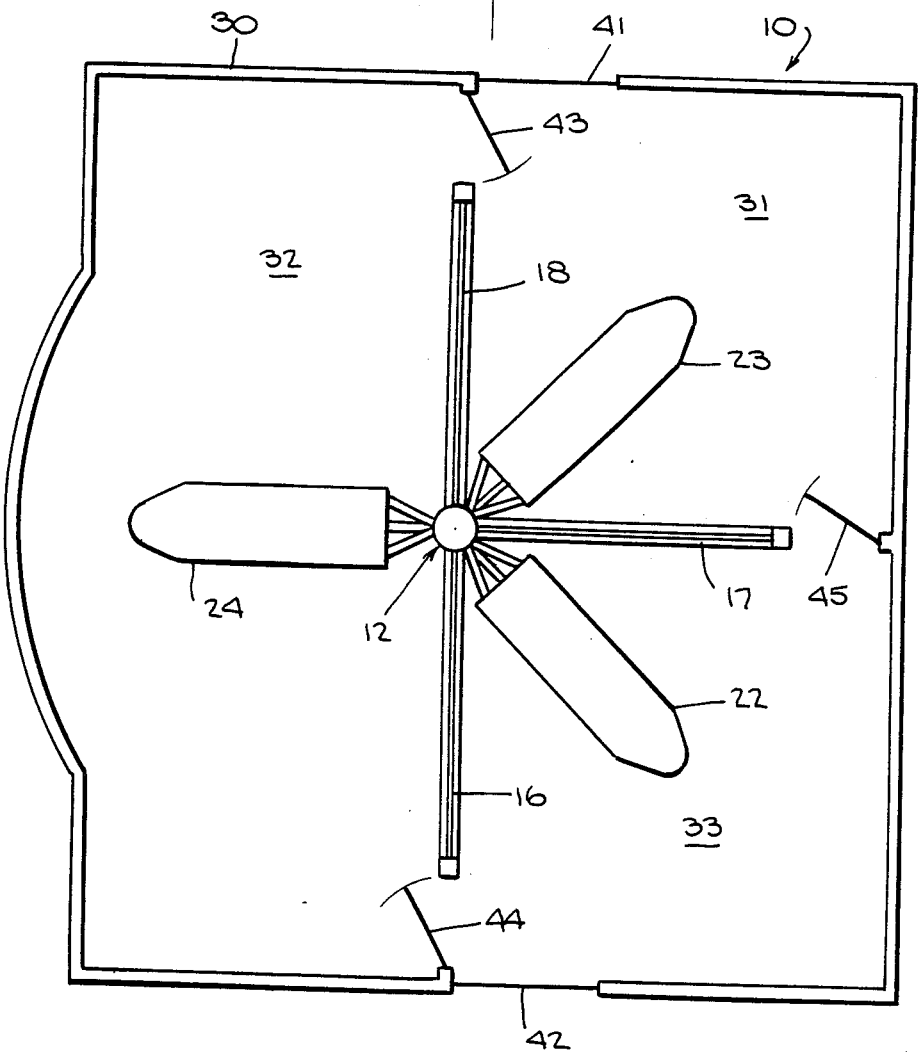
FIG. 2 is a top plan view of the FIG. 1 surgical operating room structure.
Figure 3:
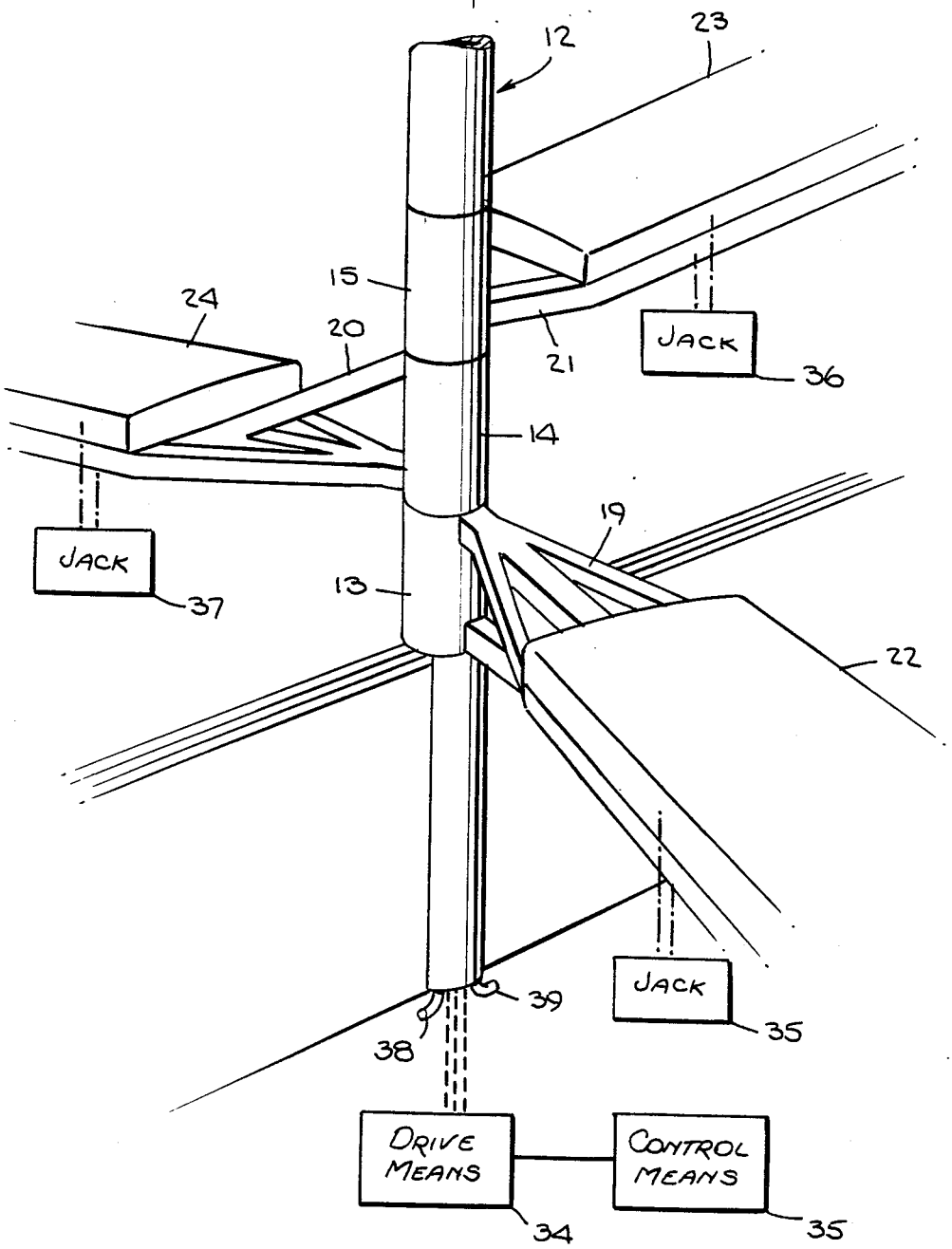
FIG. 3 is a fragmentary view, partly diagrammatic, and to an enlarged scale, of a portion of the FIG. 1 structure.

Referring now more particularly to FIGS. 1, 2 and 3 of the drawings, a surgical operating room structure 10 in accordance with the invention is represented in fragmentary view. An outer wall, as represented by broken lines 11, has been removed for clarity and a ceiling has also been removed for clarity. The structure 10 comprises a central core 12 having longitudinal sections or ring members 13, 14, 15 supported in a stacked relation in the core, as will be more fully described subsequently. The housing 30 surrounds the core and forms a work space at its interior. The housing 30 has, for example, a substantially rectangular cross section.

The surgical operating room structure includes a plurality of outwardly extending curtain means 16, 17, 18 within the housing for dividing the work space into a plurality of compartments 31, 32, 33. The central core 12 is adapted to contain all utility connections required for the various services performed in the various compartments, including temperature control, water supply, oxygen, sterilizing fluid and other utilities required for each room.

A plurality of arms 19, 20, 21 are supported by and extend generally radially outwardly from the core 12 and are movable in circumferential direction thereabout. Each of the arms extends into the housing and is adapted to support an operating table 22, 23, or 24.

As more clearly represented in FIG. 3, the operating room structure preferably includes drive means 34 for independently rotating each of the arms 21, 20, 19 in the circumferential direction consecutively into and out of adjacent ones of the compartments 31, 32, 33. The drive means 34 includes a plurality of driven ring members 13, 14, 15 supported in stacked relation in the core and each of the arms 19, 20, 21, in turn, is connected to a respective one of the ring members 22, 23, 24. The structure also includes control means 35 for the drive means 34 for independently moving the arms 19, 20, 21 into and out of the adjacent compartments. The control means 35 and the drive means 34 may, for example, be of conventional electromechanical construction, with the drive means 34 having three drive outputs, represented in broken line construction and individually connected to the ring members 13, 14, 15.

The curtain means 16, 17, 18 each comprise a movable portion adapted to be opened to permit movement of the arm therethrough from one compartment into the next adjacent compartment and adapted to be closed again subsequent to each such movement. The work space is divided into at least three compartments 31, 32, 33, one such compartment 31 being a prep room for preparing a patient for an operation, the next adjacent one 32 of the compartments being an operating room, and the third compartment 33 being a post-operative room for servicing the patient just subsequent to an operation. Each curtain means comprises a first lower rubber curtain portion, for example 16*a*, and a second upper rubber curtain portion, for example 16*b*. The rubber curtain portions overlap in the region of the rotational movement of the arms, whereby an arm, for example arm 19, moving from one compartment 32 to the next adjacent compartment 33 spreads the corresponding curtain portions apart and they move back into overlapping closed relation after passage of the respective arm therethrough. Each rubber curtain portion may, for example, be a one-half inch thick rubber sheet. Each of the arms 19, 20, 21 comprises means for supporting an operating table 22, 23, 24 and means for raising and lowering the elevation of the table with respect to such arm. This means for raising and lowering the elevation of the table may, for example, be a suitable jack 35, 36, or 37, mechanically connected, as represented in broken line construction, by any suitable conventional mechanical means between each table and the corresponding arm.

Accordingly, a patient already on an operating table enters the structure through a door in the first compartment 31 where the operating table 23 is supported by the arm 21 in that compartment, and the arm supporting the operating table and the patient is then rotated by the drive means through the curtain separating the first compartment from an adjacent second compartment 32, into the adjacent second compartment.

The operating room structure also preferably comprises sterilizing means in each of the compartments for sterilizing the compartments prior to, during, and immediately after entry of an arm carrying a patient therein. This sterilizing means may, for example, be nozzles, such as 38, 39 (FIG. 3) extending from hoses in the core 12 for flooding the floor of each compartment with an antiseptic solution immediately prior to, during and/or after each movement of an arm carrying a patient into that compartment.

The patients are discharged from the post-operative room and are admitted into the prep room through sliding doors 41, 42 in the peripheral wall of each of those rooms, as represented in FIG. 2. As also represented in FIG. 2, doors 43, 44, 45 interconnect the rooms 31, 32, 33. All of the rooms are located within a structure which may be, for example, approximately 24 feet in length and of the same width. For visibility from outside the operating room to all areas of the operating room, the exterior wall 50 and portions of the ceiling of the operating room may, for example, be made from transparent plastic material.

An operating table on wheels may be wheeled into the prep room 31, and the jack 36 raises the table to any desired height and supports it at that height. In operation, a ring member 15 moves the arm 21 and the operating table 23 carried by it from one room 31 and through the rubber-curtain wall 18 into the next adjacent room 32 of the structure. Thus, a patient is wheeled into the prep room on an operating table 23 and after the table 23 is positioned on the arm 21 and jack 37, then in the prep room, and preliminary work is done to the patient, the arm 21 carrying that operating table 23 and patient is rotated through the curtain 18, separating the prep room 31 and the operating room 32, into the operating room 32 which is adjacent thereto. After the operation, the patient is moved into the post-operative room 33, again by rotating the arm 21 through the curtained wall 16 (which closes immediately after the arm has passed through it) separating the post-operative room 33 from the operating room 32. As represented in FIG. 1, the operating table 22 and the arm 19 are passing between the curtain portions **16*a*, 16*b*** during an earlier transfer. Furthermore, each room is made antiseptic by flooding the floor of the room with an antiseptic solution immediately prior to, during and after each movement of an arm carrying a patient into that room.

If desired, at least a fourth compartment (not shown) having no arm or operating table therein may be included in the structure 10 around the central core 12 so that an arm and operating table may be moved into that compartment after an earlier procedure has been completed in the preceding adjacent compartment. Since different phases of the procedure and indeed different procedures can require longer or shorter periods of time, the three arms 19, 20, 21 may then be moved independently of one another. A control for movement of the arm in each room may then be adapted to move an arm out of such room, but preferably, though not necessarily, only after the next adjacent room has been vacated by the previous arm and sterilized.

In accordance with this invention, it is possible to maximize the use of an operating room facility by permitting patients to be moved into and out of the operating room at a fast rate. It is contemplated that the structure 10 may be prefabricated and supported on a raised platform and that all utility connections will reach the central core 12 from under the platform or from above the ceiling. It is also possible to vertically stack a plurality of these structures 10 so that additional operating facilities can be provided in minimum floor space, with a common central core extending through all.

The surgical team has access into and out of the various compartments through doors 43, 44, 45. Sliding doors 41, 42 (FIG. 2) may be provided in the walls of the post-operative room 33 and the prep room 31 for exit and entry from the prefab unit.

While there have been described what are at present considered to be the prefered embodiments of this invention, it will be obvious to those skilled in the art that various changes and modifications may be made therein without departing from the invention, and it is, therefore, aimed to cover all such changes and modifications as fall within the true spirit and scope of the invention.

I claim:

1. A surgical operating room structure comprising:

a central core;

a housing surrounding said core and forming a work space at its interior;

a plurality of generally outwardly extending curtain means within said housing for dividing the work space into a plurality of compartments;

a plurality of spaced arms supported by and extending generally radially outwardly from the core and movable in circumferential direction thereabout, each of said arms extending into said housing at above-floor level and being adapted to support an operating table;

said curtain means each comprising a movable portion adapted to be opened to permit movement of an arm therethrough from one compartment into the next adjacent compartment and adapted to be closed again subsequent to each such movement;

whereby a patient already on an operating table may enter the structure in a first compartment where the operating table is supported by the arm in that compartment, and said arm supporting the operating table and patient is then rotated through the curtain means separating said first compartment from an adjacent second compartment, into said adjacent second compartment.

2. The surgical operating room structure according to claim 1 further comprising drive means for independently rotating each of said arms in said circumferential direction consecutively into and out of adjacent ones of said compartments.

3. The surgical operating room structure according to claim 1 in which the work space is divided into at least three compartments, one such compartment being a prep room, the next adjacent one of said compartments being an operating room and the third compartment being a post-operative room.

4. A surgical operating room structure according to claim 3 wherein said curtain means comprise rubber sheets and said housing has as its outer wall in the region of the operating room a transparent portion for the viewing of the surgical procedure from outside the structure.

5. A surgical operating room structure according to claim 1 wherein said central core is adapted to contain all utility connections required for the various services performed in the various compartments.

6. A surgical operating room structure according to claim 1 wherein each said curtain means comprises a first lower flexible curtain portion and a second upper flexible curtain portion, said flexible curtain portions overlapping in the region of the rotational movement of said arms, whereby an arm moving from one compartment to the next adjacent compartment spreads the corresponding curtain portions apart and they move back into overlapping closed relation after passage of the respective arms therethrough.

7. A surgical operating room structure according to claim 2 wherein said drive means includes a plurality of driven ring members supported in stacked relation in said core and each of said arms in turn is connected to a respective one of said ring members.

8. A surgical operating room structure according to claim 7 which includes control means for said drive means for independently moving said arms into and out of the adjacent compartments, said control means being effective to cause said drive means to move an arm into a compartment only if no other arm is in said compartment.

9. A surgical operating room structure according to claim 1 wherein each of said arms comprises means for supporting an operating table and means for raising and lowering the elevation of said table with respect to the corresponding one of said arms.

10. A surgical operating room structure according to claim 1 wherein said work space is divided into three compartments and said plurality of arms comprises three arms independently movable into and out of said compartments.

11. A surgical operating room structure in accordance with claim 1 further comprising sterilizing means in at least one of said compartments for sterilizing such compartment at least prior to entry therein of an arm carrying a patient thereon.

12. A surgical operating room structure comprising:

a central core;

a housing surrounding said core and forming a work space at its interior;

a plurality of generally outwardly extending curtain means within said housing for dividing the work space into a plurality of compartments;

a plurality of arms supported by and extending generally radially outwardly from the core and movable in circumferential direction thereabout, each of said arms extending into said housing and being adapted to support an operating table;

drive means for independently rotating each of said arms in said circumferential direction consecutively into and out of adjacent ones of said compartments;

said curtain means each comprising a movable portion adapted to be opened to permit movement of an arm therethrough from one compartment into the next adjacent compartment and adapted to be closed again subsequent to each such movement;

whereby a patient already on an operating table may enter the structure in a first compartment where the operating table is supported by the arm in that compartment, and said arm supporting the operating table and patient is then rotated through the curtain means separating said first compartment from an adjacent second compartment, into said adjacent second compartment.

13. A surgical operating room structure comprising:

a central core;

a housing surrounding said core and forming a work space at its interior;

a plurality of generally outwardly entending curtain means within said housing for dividing the work space into a plurality of compartments;

a plurality of arms supported by and extending generally radially outwardly from the core and movable in circumferential direction thereabout, each of said arms extending into said housing and comprising means for supporting an operating table and means for raising and lowering the elevation of said table with respect to the corresponding one of said arms;

said curtain means each comprising a movable portion adapted to be opened to permit movement of an arm therethrough from one compartment into the next adjacent compartment and adapted to be closed again subsequent to each such movement;

whereby a patient already on an operating table may enter the structure in a first compartment where the operating table is supported by the arm in that compartment, and said arm supporting the operating table and patient is then rotated through the curtain means separating said first compartment from an adjacent second compartment, into said adjacent second compartment.

* * * * *